US012109599B2

(12) United States Patent
Videen

(10) Patent No.: US 12,109,599 B2
(45) Date of Patent: Oct. 8, 2024

(54) PAINTLESS DENT REPAIR GLUE TAB

(71) Applicant: Jonathon Videen, Coon Rapids, MN (US)

(72) Inventor: Jonathon Videen, Coon Rapids, MN (US)

( * ) Notice: Subject to any disclaimer, the term of this patent is extended or adjusted under 35 U.S.C. 154(b) by 0 days.

(21) Appl. No.: 17/839,051

(22) Filed: Jun. 13, 2022

(65) Prior Publication Data

US 2023/0398591 A1 Dec. 14, 2023

(51) Int. Cl.
*B21D 1/06* (2006.01)

(52) U.S. Cl.
CPC ..... *B21D 1/06* (2013.01)

(58) Field of Classification Search
CPC . B21D 1/06; B21D 1/065; B21D 1/10; B21D 1/12; Y10S 72/705
See application file for complete search history.

(56) References Cited

U.S. PATENT DOCUMENTS 3,765,220 A 10/1973 Kirspel
7,343,773 B1 3/2008 Chan
9,889,483 B1 2/2018 Allen
2002/0035863 A1 3/2002 Lowery
2021/0060633 A1* 3/2021 White ..... B21D 1/06
2021/0220889 A1 7/2021 White et al.

FOREIGN PATENT DOCUMENTS

EP 1287915 A1 3/2003

* cited by examiner

*Primary Examiner* — Teresa M Ekiert

(74) *Attorney, Agent, or Firm* — Christensen, Fonder, Dardi & Herbert PLLC.; Douglas J. Christensen; Andrew Auderieth

(57) ABSTRACT

A glue tab for paintless dent repair. The glue tab has a head portion and a dent lifting portion. The glue tab further includes a stem extending between the head and dent lifting portions. The dent lifting portion has an affixment portion with a flat bottom surface. The bottom surface is configured to be affixed to a dent in a vehicle body. The bottom surface further includes a first perimeter extending along an outer edge. A stepped up portion sits between the stem and the affixment portion. The stepped up portion has a second perimeter that substantially follows the first perimeter. The first perimeter is wider than the second perimeter.

16 Claims, 7 Drawing Sheets

PAINTLESS DENT REPAIR GLUE TAB

FIELD OF THE DISCLOSURE

The present disclosure relates to devices for removing surface dents. More specifically, the present disclosure relates to tabs that may be adhered to a dent and pulled upon to remove the dent.

BACKGROUND

Vehicles, such as automobiles, vessels, aircraft, and the like often have a solid frame surrounded by a thinner body. Such bodies, while generally sturdy and resilient, tend to be deformable. While this makes the bodies suitable for shaping, whether for aerodynamics, hydrodynamics, or aesthetics, this also makes such bodies readily dentable. In particular, such bodies tend to dent upon impact, such as impact with debris, during a collision, or from inclement weather such as hail.

The deformable nature of these bodies makes them suitable to repair by "popping out" or "pulling out" the dents. When particular care is take during this process, dents may be removed or smoothed out without causing any further surface damage. For example, it may be possible to pull out a dent and restore the original shape of a vehicle body without damaging or otherwise requiring painting, which can be time consuming, costly, and prone to leave undesirable visual artifacts, such as when colors used during repair don't exactly match the original, surrounding paint; see, for example, U.S. Patent Publication 20210220889, the contents of which are incorporated herein for all purposes. However, devices and tools currently used to pull out a dent have several drawbacks. In particular, such devices and tools are not well suited to evenly dispersing a pulling force across a dented area. Accordingly, when a dent is pulled out with existing tools, it may result in the outer edges of the dent being pulled out while leaving a depression in the middle of the dent, resembling a volcano shape. If a dent is not pulled out uniformly, it must be pounded back down and the repair process restarted from the beginning. A device that improves the reliability of pulling out a dent on a first attempt would be welcome.

SUMMARY OF THE INVENTION

A glue tab for paintless dent repair includes a head portion, a dent lifting portion, and a stem. The stem extends between the dent lifting portion and the head portion. The dent lifting portion includes an affixment portion having a flat bottom surface. The flat bottom surface is configured to be affixed to a dent in a vehicle body. A first perimeter extends along an outer edge of the flat bottom surface. A stepped up portion is located between the stem and the affixment portion. The stepped up portion has a second perimeter which substantially follows the first perimeter. The first perimeter is wider than the second perimeter.

In embodiments, the affixment portion has a first thickness and the stepped up portion has a second thickness. The first and second thicknesses may be substantially similar. In embodiments, a difference in width between the first and second margins remains constant around an entirety of the perimeters of the affixment portion and the stepped up portion. In embodiments, the difference in width is between 0.5 and 3.5 mm. In embodiments, the difference in width is about 1 mm. In embodiments, a planar cross section of the affixment portion is geometrically similar to a planar cross section of the stepped up portion. In embodiments, the head portion is configured to interface with a pulling tool. In embodiments, the head portion comprises a hexagonal top surface. In embodiments, a first end of the stem is generally centered on the stepped up portion and an opposite end of the stem is generally centered on the head portion.

According to embodiments of the invention, a device for removing dents from a vehicle body includes a first lifting surface, a second lifting surface disposed on top of the first lifting surface, and a gripping portion affixed to the second lifting surface. The first lifting surface is configured for attachment to a vehicle body. The second lifting surface is set back from an outside edge of the first lifting surface. The second lifting surface defines a margin around the first lifting surface such that the margin has a constant width.

In embodiments, a neck extends between the second lifting surface and the gripping portion. The neck is narrower than the second lifting surface. In embodiments, the first and second lifting surfaces each define a circular shape. In embodiments, the first and second lifting surfaces each define a shape with three or more sides, where each side has an equal length. In embodiments, the first and second lifting surfaces each define a shape with four or more sides, such that a pair of opposing sides is longer than the remaining sides.

According to embodiments of the disclosure, a glue tab for pulling dents from vehicle bodies includes a head portion and a dent attachment portion. The head portion is configured to interface with a pulling tool. The dent attachment portion has a margin configured to flex when the dent attachment portion is affixed to a dent in the vehicle body and a pulling force is applied the head portion by the pulling tool.

In embodiments, the dent attachment portion has a generally symmetrical planar bottom surface. In embodiments, the dent attachment portion has an elongated planar bottom surface. In embodiments, the dent attachment portion has an elongated stepped up portion disposed above the bottom surface. In embodiments, a neck portion extends vertically between the stepped up portion and the head portion. In embodiments, one or more arms extends downwardly from the neck portion to the elongated stepped up portion along a longitudinal axis of the elongated stepped up portion. In embodiments, the margin is defined by an offset between an outer edge of the bottom surface and an outer edge of the stepped up portion. The margin has a generally fixed width about the entirety of the dent attachment portion.

A feature and advantage of embodiments is a margin of the portion of the glue tab affixed to a dent flexes when pulled. A feature and advantage of embodiments is the glue tab drives force towards the stem when pulled. A feature and advantage of embodiments is the glue tab uniformly lifts a dent when pulled. A feature and advantage is the flexion of the bottom surface of the glue tab prevents a volcano effect from occurring when a dent is lifted. Dents that are not uniformly lifted can have defects, such as raised edges and/or a depressed center, requiring that the partially lifted dent be pounded down and the repair process restarted, wasting time, materials, and effort.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure. Embodiments of the invention will be described with respect to the figures, in which like reference numerals denote like elements, and in which.

Figure 1B:
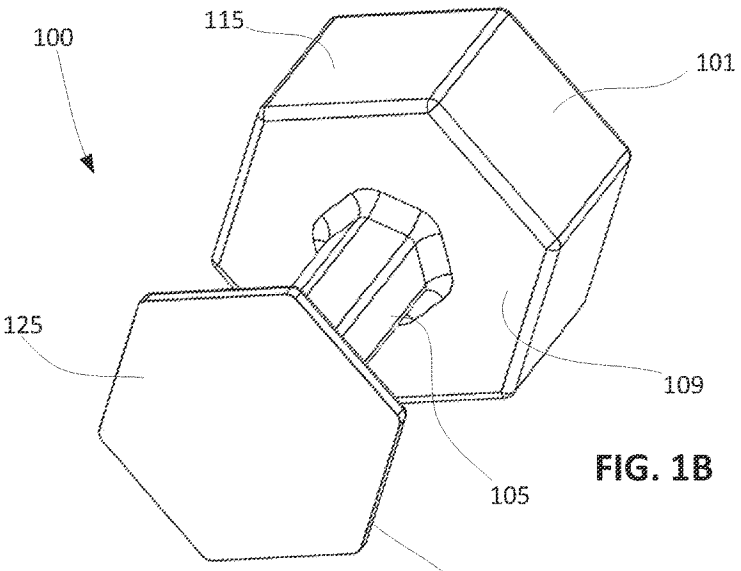
FIG. 1B depicts a perspective bottom view of the paintless dent repair glue tab of FIG.
Figure 1D:
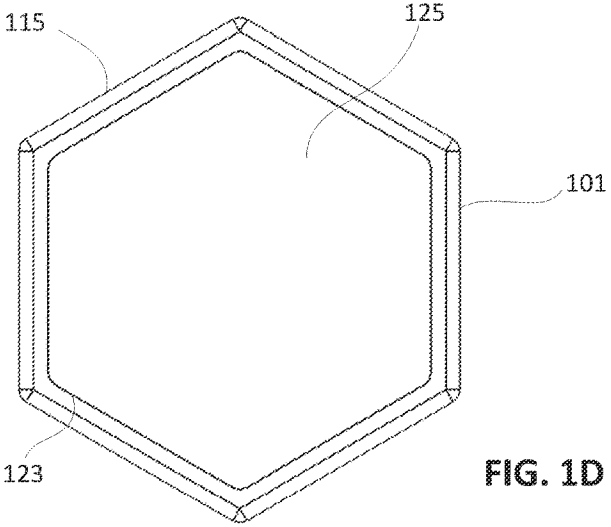
FIG. 1D depicts a bottom view of the paintless dent repair glue tab of FIG. 1A.
Figure 1A:
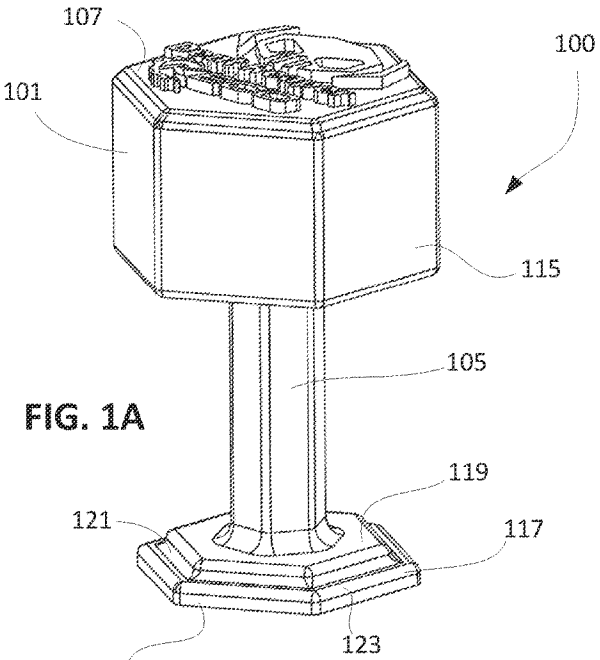
FIG. 1A depicts a perspective front view of a paintless dent repair glue tab according to embodiments. 1A.
Figure 1C:
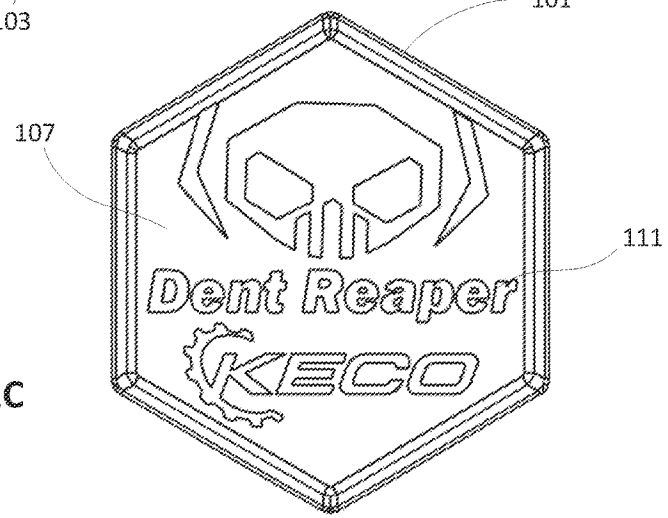
FIG. 1C depicts a top view of the paintless dent repair glue tab of FIG. 1A.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIGS. 1A-F, a paintless dent repair glue tab 100 is shown suitable for removing dents from a vehicle body. Glue tab 100 has a head portion 101, a pulling portion 103, and a stem portion 105. Stem portion 105 extends from pulling portion 103 to head portion 101. Head portion 101 includes a top surface 107 opposite bottom surface 109 and one or more sidewalls 115 there between. Top surface 107 may include indicia 111. In embodiments, indicia may be product markings or the like. In embodiments, indicia may be a size indicator allowing a user to easily locate the desired glue tab. In particular, it may be desirable to select a glue tab having a bottom surface that corresponds to a dent. Such correlation may be, for example, similar size and/or shape.

Head portion 101 may be of various sizes and shapes in order to be received by a pulling tool. Such tools are disclosed, for example, in U.S. Pat. No. 7,343,773 and U.S. Patent Publication 20210220889, the contents of which are incorporated herein for all purposes, teachings, and suggestions. In embodiments, head portion 101 may be circular. In embodiments, head portion 101 may be hexagonal. Head portion 101 may have a width 113 that matches a receiving opening in a pulling tool. In embodiments, width 113 is between 8 and 18 mm. In embodiments, width 113 is between 12 and 15 mm. In embodiments, width 113 is about 14 mm. In embodiments, had portion 101 has a height 137 between 5 and 10 mm. In embodiments, height 137 is about 8 mm.

Pulling portion 103 includes a bottom pulling layer 117 and a stepped up pulling layer 119. A margin 121 extends around an outer perimeter of bottom pulling layer 117 between an outside edge 123 and the second pulling layer 119. Bottom pulling layer 117 has a bottom surface 125 configured to receive an adhesive and be adhered to a dent, as discussed in further detail below. In embodiments, bottom surface 125 is generally planar.

Figure 1F:
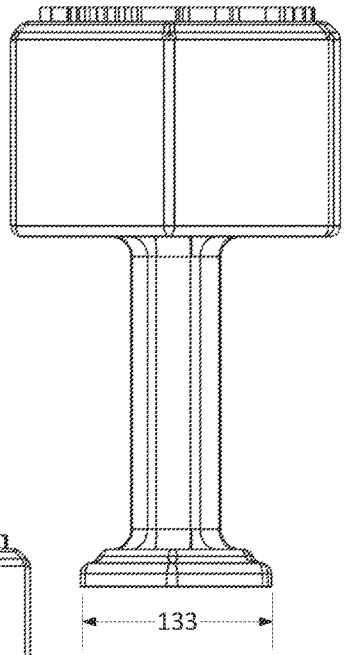
FIG. 1F depicts a side view of a paintless dent repair glue tab according to embodiments.
Figure 1G:
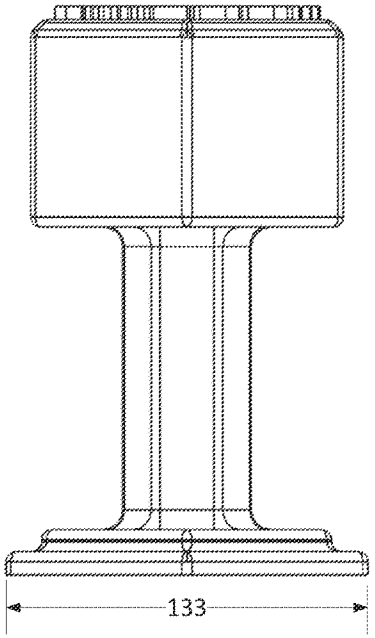
FIG. 1G depicts a side view of a paintless dent repair glue tab according to embodiments.
Figure 1E:
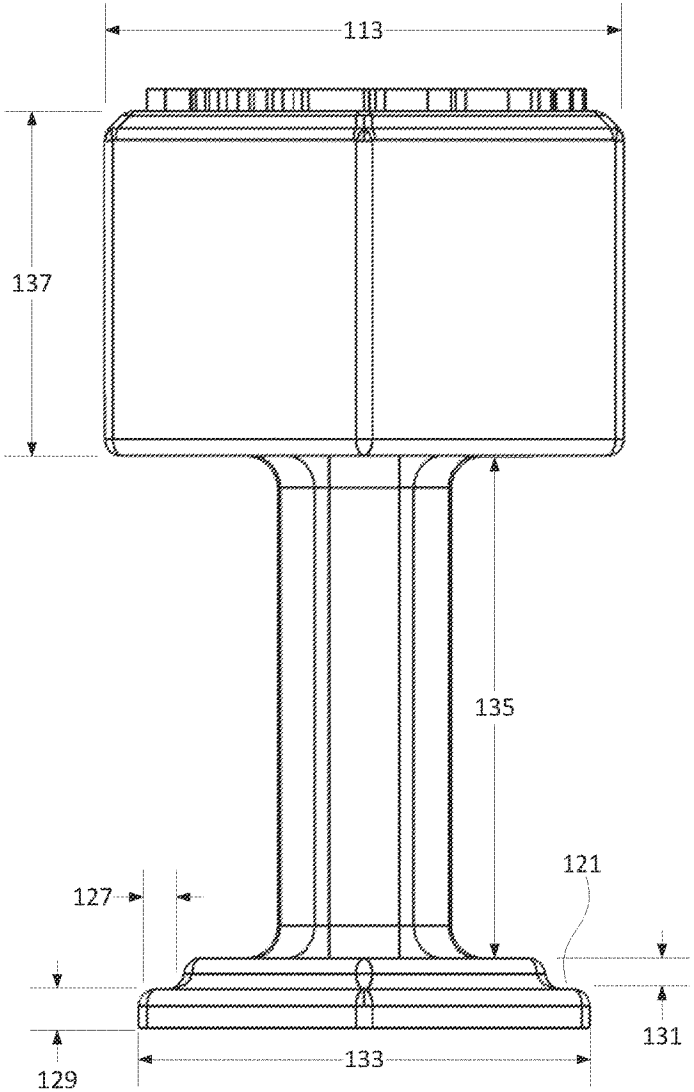
FIG. 1E depicts an enlarged side view of the paintless dent repair glue tab of FIG. 1A.

Stepped up layer 119 is generally geometrically similar to bottom pulling layer 117. Accordingly, margin 119 has a generally constant width 127 around the outer edge 123 of the bottom pulling 117. In embodiments, margin width 127 is between 0.5 and 3.5 mm. In embodiments, margin width 127 is about 1 mm. In embodiments a thickness 129 of bottom layer 117 is substantially the same as a thickness 131 of stepped up layer 119. In embodiments, thicknesses 129, 131 are each between 0.2 and 1.5 mm. In embodiments, thicknesses 129,131 are each about 0.5 mm. In embodiments, thicknesses 129,131 of bottom layer 117 and stepped up layer 119 may be different. When the thicknesses are varied, it may affect the flexing of the outside edge of pulling portion 103, as discussed in further detail below. In embodiments, layers 117, 119 may have a variety of geometric shapes such as circular, oval, hexagonal, or the like. Bottom layer has width 133. In various embodiments of the glue tab, width 133 may differ such that a user has a choice of glue tabs suited to repairing different sized or shaped dents. FIGS. 1F and 1G depict glue tabs having different bottom layer widths 133. While the width 133 of bottom layer varies, it should be noted the dimensions of head portion 101 generally do not change. Maintaining consistency of the head portion dimensions, among various embodiments of glue tabs having varying sized pulling portions, allows a single pulling tool to be operable with the various embodiments of glue tabs. In embodiments, width 133 is between 6 and 20 mm. In embodiments, width 133 is 8, 10, 12, 14, or 16 mm.

Figure 2B:
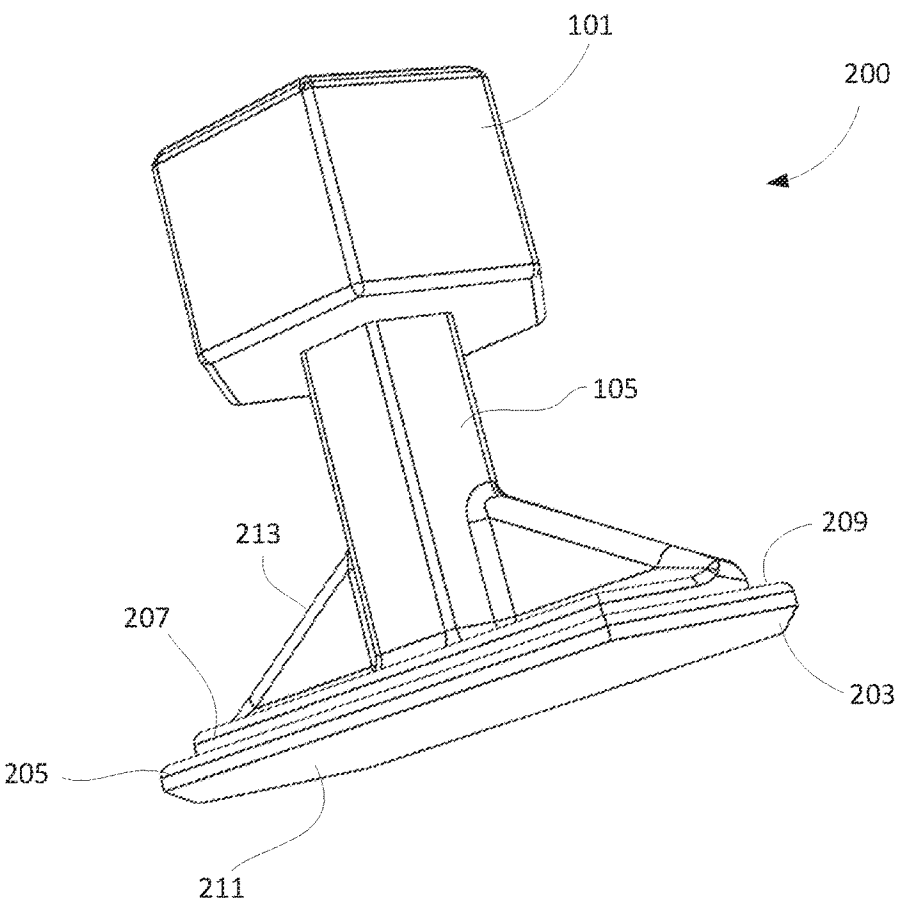
FIG. 2B depicts a perspective bottom view of the paintless dent repair glue tab of FIG. 2A.
Figure 2A:
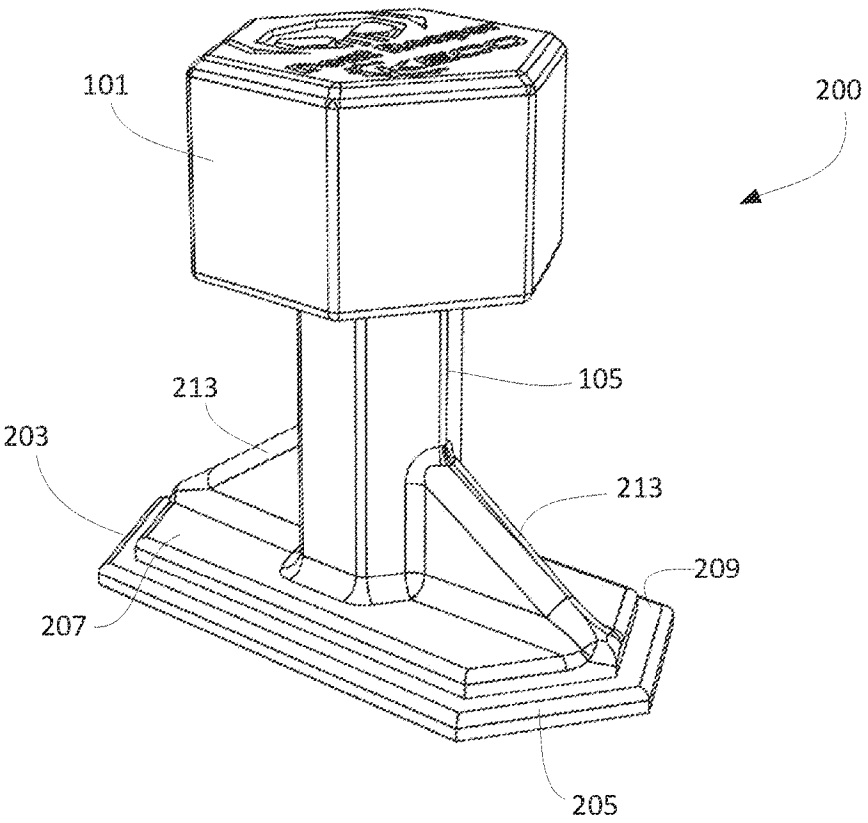
FIG. 2A depicts a perspective front view of a paintless dent repair glue tab according to embodiments.
Figure 2C:
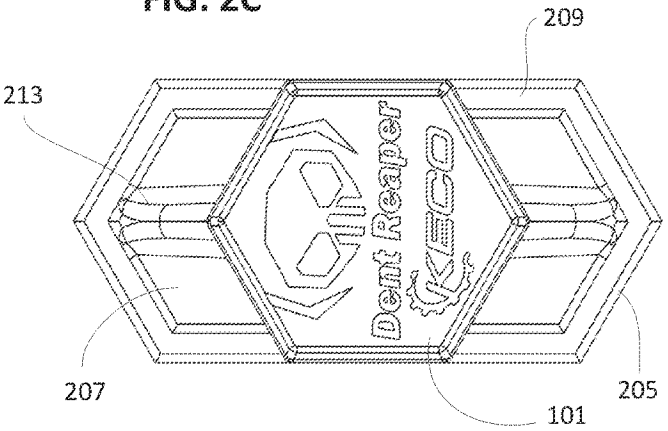
FIG. 2C depicts a top view of the paintless dent repair glue tab of FIG. 2A.
Figure 2D:
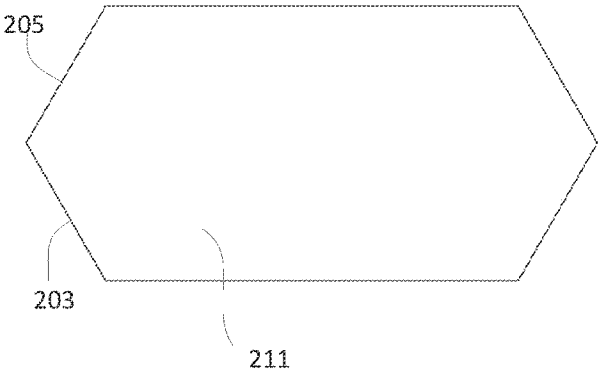
FIG. 2D depicts a bottom view of the paintless dent repair glue tab of FIG. 2A.
Figure 2E:
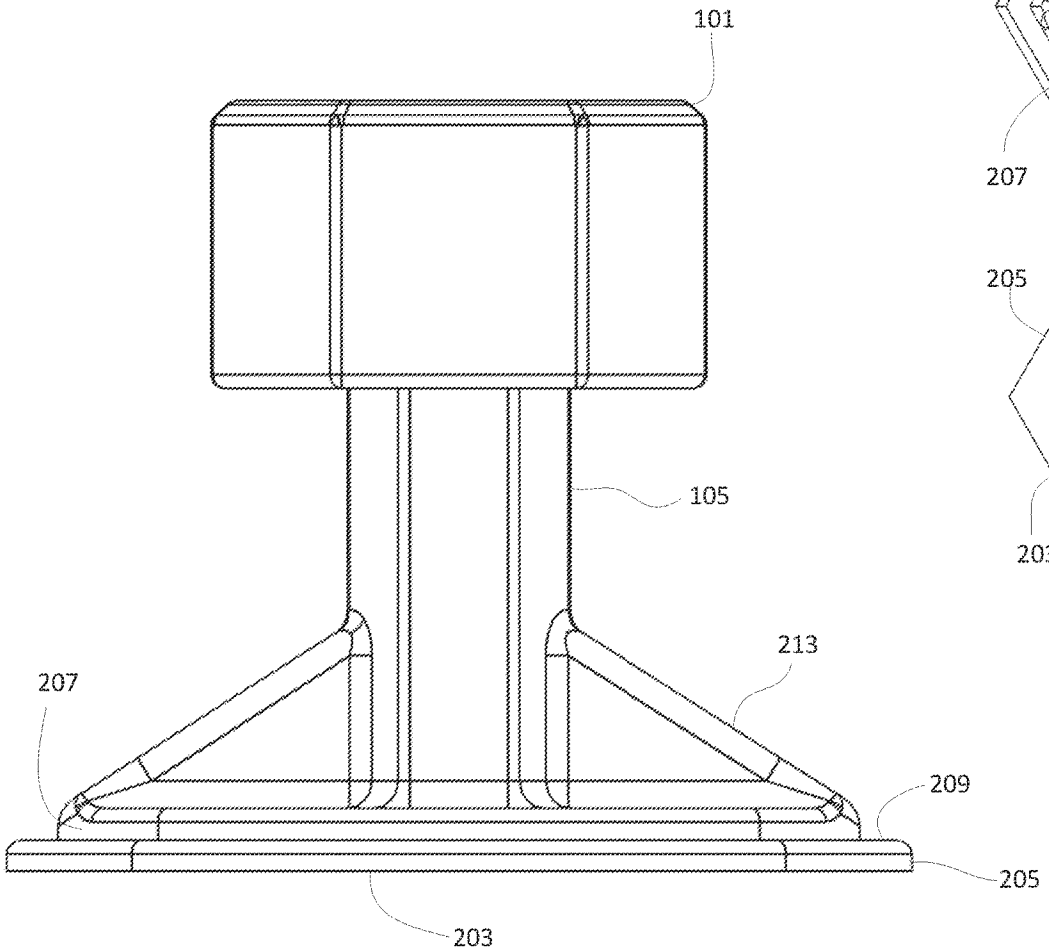
FIG. 2E depicts an enlarged side view of the paintless dent repair glue tab of FIG. 2A.
Figure 2G:
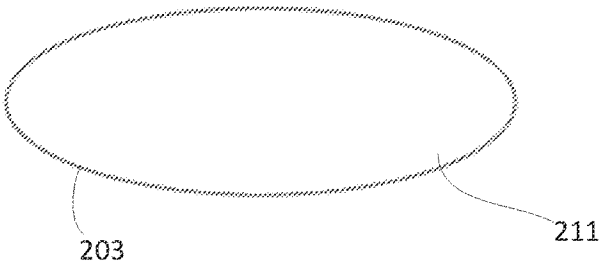
FIG. 2G depicts a bottom view of the paintless dent repair glue tab of FIG. 2F.
Figure 2I:
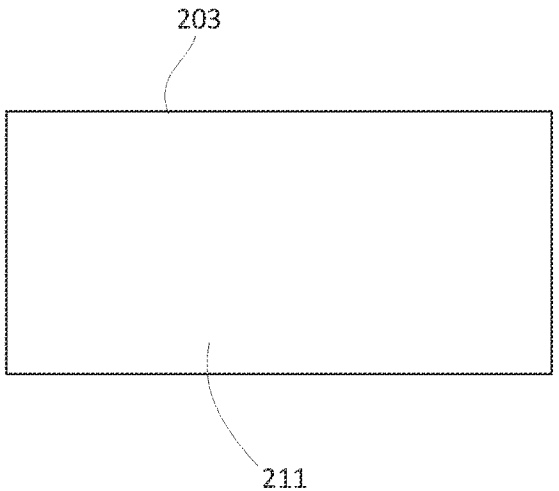
FIG. 2I depicts a bottom view of the paintless dent repair glue tab of FIG. 2H.
Figure 2F:
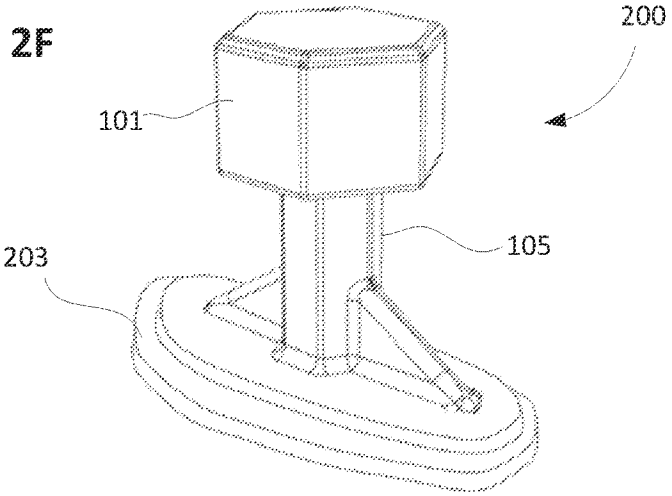
FIG. 2F depicts a perspective front view of a paintless dent repair glue tab according to embodiments.
Figure 2H:
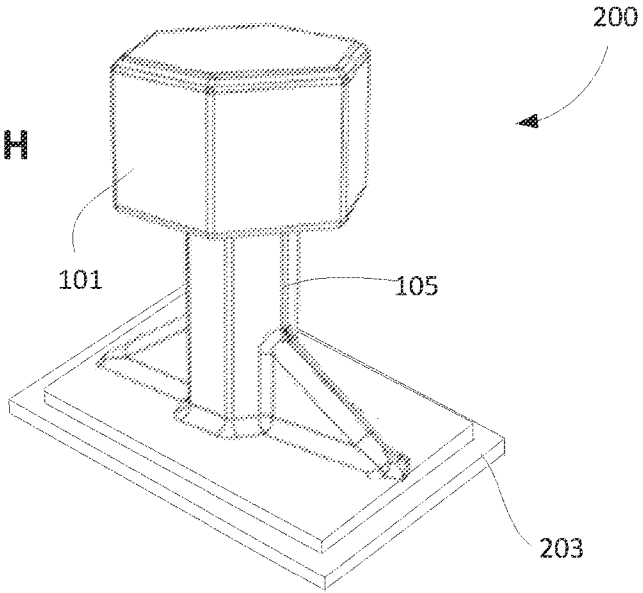
FIG. 2H depicts a perspective front view of a paintless dent repair glue tab according to embodiments.
Figure 2K:
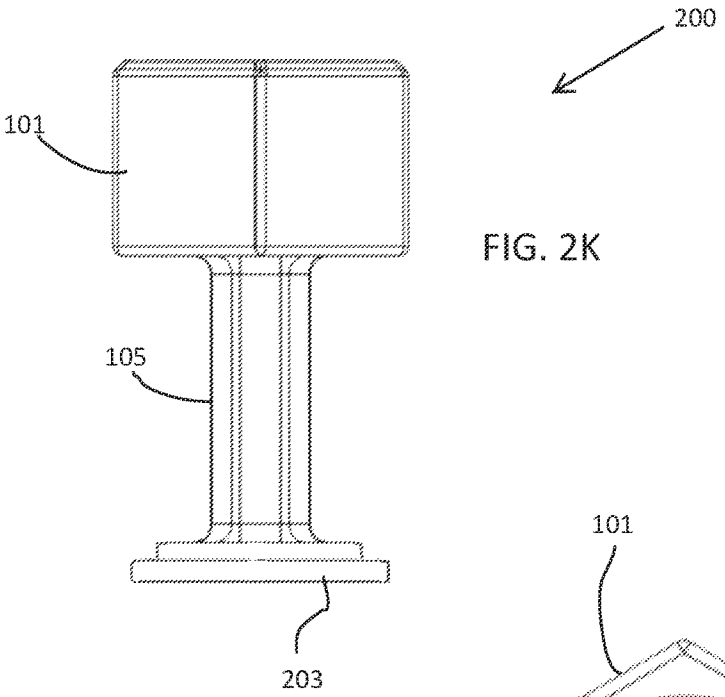
FIG. 2K depicts a side view of the paintless dent repair glue tab of FIG. 2J.
Figure 2L:
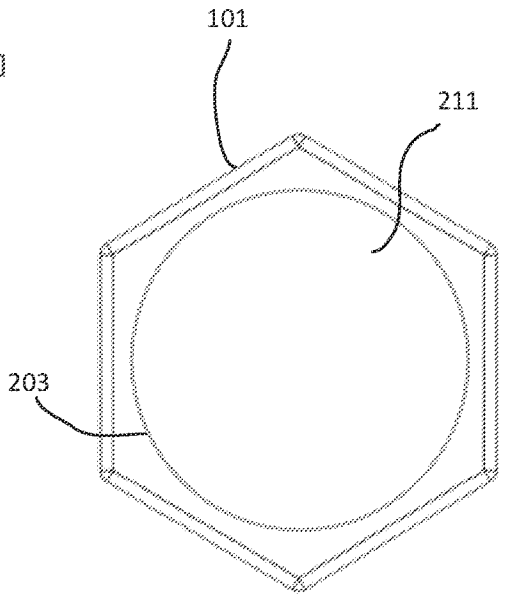
FIG. 2L depicts a bottom view of the paintless dent repair glue tab of FIG. 2J.
Figure 2J:
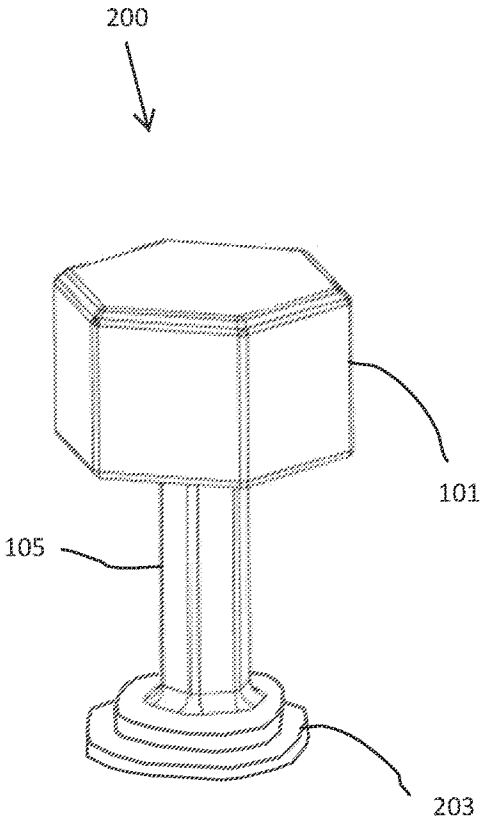
FIG. 2J depicts a perspective front view of a paintless dent repair glue tab according to embodiments.
Figure 3D:
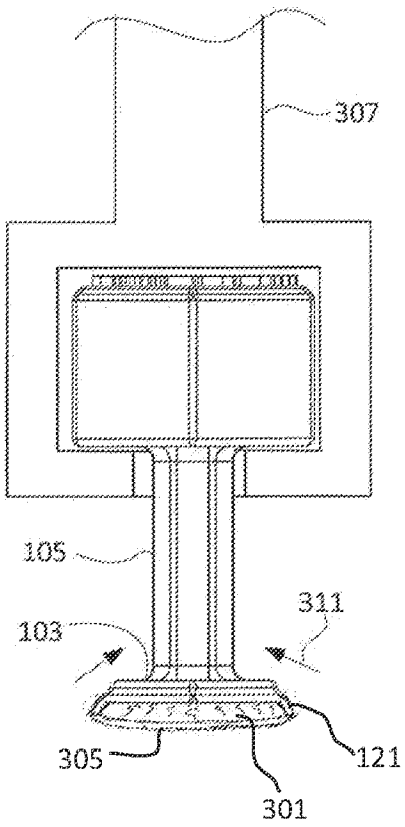
FIG. 3D depicts a side view of the paintless dent repair glue tab of FIG. 3C being pulled by the tool.
Figure 3C:
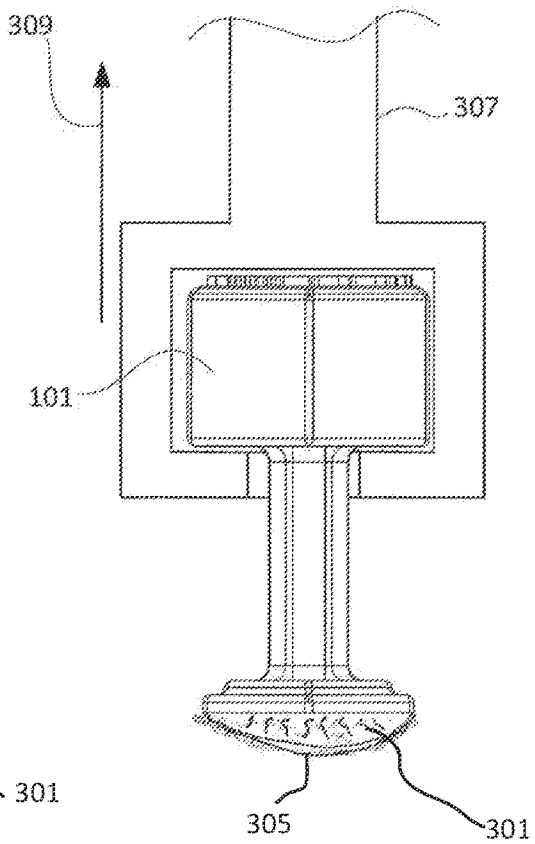
FIG. 3C depicts a side view of the paintless dent repair glue tab of FIG. 3B inserted into a tool.
Figure 3B:
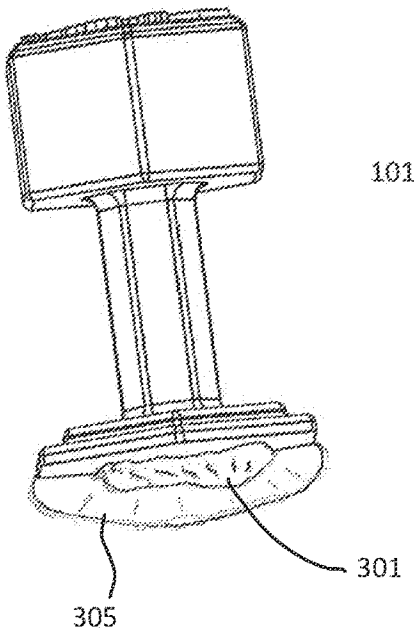
FIG. 3B depicts a perspective view of the paintless dent repair glue tab of FIG. 3A being affixed to a dent.
Figure 3A:
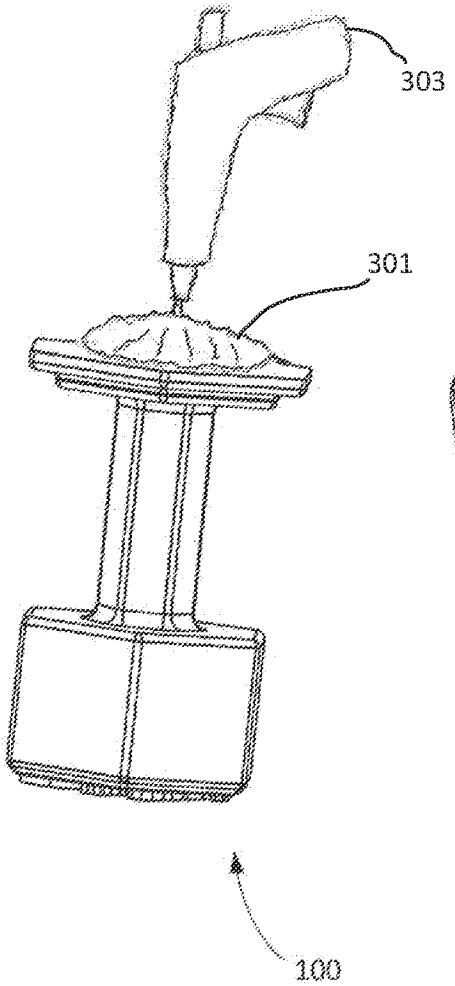
FIG. 3A depicts a perspective view of a paintless dent repair glue tab according to embodiments receiving adhesive.

As dents may be formed in a variety of shapes and sizes, it is useful to have a pulling portion in different shapes and sizes. FIGS. 2A-I illustrate a glue tab 200 having an elongated pulling portion 203. FIGS. 2J-L illustrate a glue tab having a circular pulling portion 203. In embodiments, elongated pulling portion 203 may be hexagonal, oval, rectangular, or the like. Pulling portion 203 include a bottom layer 205 with a bottom surface 211 configured to be adhered to a vehicle body. Stepped up layer 207 is sandwiched between bottom layer 205 and neck 105. Stepped up layer 207 is geometrically similar to and set back from bottom layer 203, such that margin 209 extends around a perimeter of bottom layer 205. Some elongated shapes of pulling portion 203 may lead to structural instability or breakage when glue tab 200 is pulled. Accordingly, embodiments of the invention may include one or more arms 213 extending from neck 105 and along the central axis of stepped up layer 207. In embodiments, arm 213 may be generally triangular shaped. In embodiments, arm 213 may taper downwardly from neck 105 to an outer edge of stepped up layer 207.

Glue tabs according to embodiments may be injection molded, blow molded, or made using similar techniques. In embodiments, glue tabs may be made of plastic. In embodiments, glue tabs may be polycarbonate, polyethylene, polypropylene or the like. In embodiments, the head portion is generally very rigid and adapted for receiving a pulling force from a pulling tool without breakage. In embodiments, the neck and pulling portion may be made of the same or similar materials as the head portion. In embodiments, the pulling portion be more flexible than the head portion. Some degree of flexing in the pulling portion when pulling out a dent may be desirable to more uniformly remove the dent. Glue tabs formed from metal, wooden materials, engineered materials, or other like materials as known in the art are not beyond the scope of this disclosure. In embodiments, glue tabs may be formed from combinations of materials. For example, the pulling portion may be plastic while the head portion is metal.

Referring to FIGS. 3A-3D, a method of removing a dent with a glue tab according to embodiments of the invention is illustrated. An adhesive, such as glue 301, is administered to the bottom surface 125 of glue tab 100. Glue 301 may be administered using a glue gun 303 or other means known in the art. Adhesive 301 is then positioned over a dent 305, and the glue tab 100 is pressed into place such that the adhesive 301 bonds the dent 305 to glue tab 100. Pulling tool 307 is secured about head portion 101, and a pulling tool 307 is pulled in an upward direction away from dent 305. When the glue tab is pulled, pulling force 311 is exerted along an edge of the pulling portion 103 and towards neck 105. Pulling portion 103 will flex about margin 121, causing the bottom surface of the pulling portion to cup. This results in a more uniform pull across the dent, with a longer pull on the deeper portions of the dent and less about the edges. Accordingly, the dent will pop out in a uniform manner, and not leave behind aberrations, such as a volcano shape with a depressed center, which requires laboriously pounding out the aberrations and restarting the dent repair process. Once the dent is pulled out, the adhesive may be dissolved, such as with alcohol, so that the glue tab may be removed without any damage to paint or the body surface.

The following U.S. patents and U.S. patent publications contain content, aspects, structure, components, and functionalities relating to or applicable to paintless dent repair devices, kits, and methods of use, and are incorporated by reference herein in their entireties for all purposes: U.S. Pat. Nos. 3,765,220; 9,889,483; and US20210060633.

Although the present invention has been described with reference to particular embodiments, those skilled in the art will recognize that changes may be made in form and substance without departing from the spirit and scope of the invention. The embodiments described above are intended to be illustrative and not limiting.

What is claimed is:

1. A glue tab for paintless dent repair comprising:

a head portion; a dent lifting portion; and a stem there between, wherein the dent lifting portion comprises an affixment portion having a flat bottom surface configured to be affixed to a dent in a vehicle body and a first perimeter extending along an outer edge of the flat bottom surface; and a stepped up portion between the stem and the affixment portion, the stepped up portion having a second perimeter that substantially follows the first perimeter, wherein the first perimeter is wider than the second perimeter, wherein the affixment portion has a first thickness and the stepped up portion has a second thickness, the first and second thicknesses being substantially similar.

2. The glue tab of claim 1, wherein a difference in width between the first and second perimeters remains constant around an entirety of the perimeters of the affixment portion and the stepped up portion.

3. The glue tab of claim 2, wherein the difference in width is between 0.5 and 3.5 mm.

4. The glue tab of claim 2, wherein the difference in width is about 1 mm.

5. The glue tab of claim 1, wherein a planar cross section of the affixment portion is geometrically similar to a planar cross section of the stepped up portion.

6. The glue tab of claim 1, wherein the head portion is configured to interface with a pulling tool.

7. The glue tab of claim 1, wherein the head portion comprises a hexagonal top surface.

8. The glue tab of claim 1, wherein a first end of the stem is generally centered on the stepped up portion and an opposite end of the stem is generally centered on the head portion.

9. A device for removing dents from a vehicle body comprising:

a first lifting surface having a thickness between 0.2 and 1.5 mm, the first lifting surface configured for attachment to the vehicle body;

a second lifting surface disposed on top of the first lifting surface, the second lifting surface being set back from an outside edge of the first lifting surface, wherein the second lifting surface defines a margin between an outer edge of the first lifting surface and an outer edge of the second lifting surface, the margin having a constant width; and a gripping portion affixed to the second lifting surface, wherein the constant width of the margin is between 0.5 and 3.5 mm.

10. The device of claim 9, wherein a neck extends between the second lifting surface and the gripping portion, wherein the neck is narrower than the second lifting surface.

11. The device of claim 9, wherein the first and second lifting surfaces define a circular shape.

12. The device of claim 9, wherein the first and second lifting surface defines a shape with three or more sides, each side having an equal length.

13. The device of claim 9, wherein the first and second lifting surface defines a shape with four or more sides, wherein a pair of opposing sides is longer than the remaining sides.

14. A glue tab for pulling dents from vehicle bodies comprising:

a head portion configured to interface with a pulling tool;

a dent attachment portion having an elongated planar bottom surface and a margin configured to flex when the dent attachment portion is affixed to a dent in the vehicle body and a pulling force is applied the head portion by the pulling tool, wherein the dent attachment portion comprises an elongated stepped up portion disposed above the bottom surface; and a neck portion extending vertically between the stepped up portion and the head portion, wherein an arm extends downwardly from the neck portion to the elongated stepped up portion along a longitudinal axis of the elongated stepped up portion.

15. The glue tab of claim 14, wherein the elongated planar surface of the dent attachment portion is generally symmetrical about the longitudinal axis.

16. The glue tab of claim 14, wherein the margin is defined by an offset between an outer edge of the bottom surface and an outer edge of the stepped up portion, the margin having a generally fixed width about the entirety of the dent attachment portion.

* * * * *